US009574162B2

(12) United States Patent
Adamy et al.

(10) Patent No.: US 9,574,162 B2
(45) Date of Patent: Feb. 21, 2017

(54) LIQUID DETERGENT FORMULATION CONTAINING PEROXIDE AND A METAL-BASED BLEACH CATALYST

(75) Inventors: Steven T. Adamy, Lawrenceville, NJ (US); Lauren Ciemnolonski, Princeton, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 918 days.

(21) Appl. No.: 13/221,983

(22) Filed: Aug. 31, 2011

(65) Prior Publication Data

US 2012/0053109 A1 Mar. 1, 2012

Related U.S. Application Data

(60) Provisional application No. 61/378,726, filed on Aug. 31, 2010.

(51) Int. Cl.

| | |
|---|---|
| ***C11D 3/20*** | (2006.01) |
| ***C11D 3/43*** | (2006.01) |
| ***C11D 3/39*** | (2006.01) |
| ***C11D 3/395*** | (2006.01) |
| ***C11D 1/00*** | (2006.01) |

(52) U.S. Cl.

CPC ..... *C11D 3/3932* (2013.01); *C11D 1/00* (2013.01); *C11D 3/2041* (2013.01); *C11D 3/2044* (2013.01); *C11D 3/2065* (2013.01); *C11D 3/3905* (2013.01); *C11D 3/3942* (2013.01); *C11D 3/3945* (2013.01); *C11D 3/3947* (2013.01)

(58) Field of Classification Search

CPC ..... C11D 1/00; C11D 3/2041; C11D 3/2044; C11D 3/2065; C11D 3/3905; C11D 3/3942; C11D 3/3945; C11D 3/3947

USPC ..... 510/303, 311, 336, 337, 340, 372, 376, 510/505, 506

See application file for complete search history.

(56) References Cited

U.S. PATENT DOCUMENTS

| | | | | |
|---|---|---|---|---|
| 4,189,501 | A | 2/1980 | Fulton, Jr. | |
| 4,350,681 | A | 9/1982 | Fulton, Jr. | |
| 4,812,173 | A | 3/1989 | Tsao et al. | |
| 4,892,854 | A | 1/1990 | Pastorino et al. | |
| 4,940,732 | A | 7/1990 | Pastorino et al. | |
| 5,607,698 | A | 3/1997 | Martin et al. | |
| 5,725,887 | A | 3/1998 | Martin et al. | |
| 5,858,948 | A * | 1/1999 | Ghosh et al. | 510/300 |
| 6,087,312 | A * | 7/2000 | Masotti et al. | 510/309 |
| 7,074,748 | B2 * | 7/2006 | Becks et al. | 510/296 |
| 2003/0045442 | A1 * | 3/2003 | Hage et al. | 510/302 |
| 2003/0148906 | A1 * | 8/2003 | Alam et al. | 510/221 |
| 2004/0063601 | A1 * | 4/2004 | Denome et al. | 510/407 |
| 2004/0149311 | A1 * | 8/2004 | Foley et al. | 134/4 |
| 2004/0167048 | A1 * | 8/2004 | Sunder et al. | 510/220 |
| 2005/0215457 | A1 * | 9/2005 | Becks et al. | 510/438 |

FOREIGN PATENT DOCUMENTS

| | | |
|---|---|---|
| JP | 06313005 | 11/1994 |

* cited by examiner

*Primary Examiner* — Gregory R Delcotto

(74) *Attorney, Agent, or Firm* — Church & Dwight Co., Inc.

(57) ABSTRACT

A stable, liquid bleach composition is disclosed. The composition comprises a peroxide-based bleaching agent, water, a metal catalyst, and a polyol. The polyol is a secondary solvent that promote peroxide stability in the presence of a catalyst.

10 Claims, 2 Drawing Sheets

LIQUID DETERGENT FORMULATION CONTAINING PEROXIDE AND A METAL-BASED BLEACH CATALYST

CROSS-REFERENCE TO RELATED APPLICATION

This application is related to U.S. Provisional Patent Application Ser. No. 61/378,726 filed Aug. 31, 2010 and takes priority therefrom.

FIELD OF THE INVENTION

This invention relates to novel liquid cleaning detergent compositions containing peroxide and a catalyst.

BACKGROUND

Hydrogen peroxide solutions have been used for many years for a variety of purposes, including bleaching, disinfecting, and cleaning a variety of things and surfaces ranging from skin, hair, and mucous membranes to contact lenses to household and industrial surfaces and instruments. In particular, peroxide-containing bleaching agents have long been used in washing and cleaning processes. When soiled clothing is contacted with such bleaching compositions, usually by washing the soiled clothing in the presence of the bleaching composition at the boil, the bleaching agent functions to remove such common domestic stains as tea, coffee, fruit and wine stains from clothing.

Traditionally, to clean a substrate such as clothing, the substrate is subjected to hydrogen peroxide, or to substances which can generate hydroperoxyl radicals, such as inorganic or organic peroxides. Generally, these peroxide systems must be activated in order to work properly. One method of activating the system is to employ wash temperatures of 60° C. or higher, but it is often advantageous to wash laundry in cold water (e.g., temperatures from about 2-24° C.). Washing in cold water generally conserves energy and therefore costs less money than washing in warm water. Other advantages include potentially less damage to clothes. However, if the washing temperature is reduced to below 60° C., the efficacy of the peroxides in the bleaching agent is correspondingly reduced.

In order to avoid having to employ wash temperatures of 60° C. or higher, it is well-known that certain heavy metals, or complexes thereof, function to catalyze the decomposition of hydrogen peroxide, or of compounds which are capable of liberating hydrogen peroxide, in order to render the peroxide compound effective at temperatures below 60° C. Various transition metal ions added in the form of suitable salts, and coordination compounds containing such cations, are known to activate hydrogen peroxide ($H_2O_2$). In that manner, by using certain heavy metals as catalysts, it is possible for the bleaching effect (which is unsatisfactory at lower temperatures) of $H_2O_2$, or precursors that release $H_2O_2$ and of other peroxo compounds, to be increased.

In terms of $H_2O_2$ activation having effective bleaching action, mononuclear and polynuclear variants of manganese complexes having various ligands, especially 1,4,7-trimethyl-1,4,7-triazacyclononane and optionally oxygen-containing bridging ligands, are currently regarded as being especially effective. Such catalysts are adequately stable under practical conditions and, with $Mn^{n+}$, contain an ecologically acceptable metal cation, but their use is unfortunately associated with considerable damage to dyes and fibres.

For example, in U.S. Pat. No. 5,114,511, there is described the activation of a peroxy compound by a complex formed from a transition metal (Mn, Co, Fe or Cu) and a non-(macro)cyclic ligand, preferably 2,2-bispyridylamine or 2,2-bispyridylmethane.

Moreover, in U.S. Pat. No. 5,114,606, there is disclosed a manganese complex, for use as a bleach catalyst for a peroxy compound, which is a water-soluble complex of manganese II, III or IV, or mixtures thereof, with a ligand which is a non-carboxylate polyhydroxy compound, having at least three consecutive C—OH groups in its molecular structure, preferably sorbitol.

The incorporation of some ingredients into detergent compositions is problematic. Detergent compositions are often stored for some time and interactions may occur between active components such that a reduction in the amount of the active component may result. This can be particularly problematic in the presence of moisture.

Many ways of protecting and delivering sensitive, highly active, low dosage detergent components have been suggested. In EP-A-0072166, EP-A-0124341, EP-A-224952 and WO 95/06710, heavy metal complexes are incorporated into detergent compositions in agglomerated or aggregate form in order to improve storage stability. In EP-A-170346, bleach catalysts are adsorbed onto solid silicon supports. In EP-A-141 470, heavy metal ion catalysts are protected by selecting specific ligands and then providing a protective coating; in EP-A-141472, micronised coatings are described. In EP-A-544 440, gelled polymers are used; in WO 95/33817, wax encapsulation is used requiring a surfactant in the particle. Unfortunately, coating methods are costly and coated/encapsulated particles are vulnerable to fissures or incomplete coatings leading to loss of the active component(s) in the particle.

Problems arise in the addition to the formulation or incorporation of a bleaching (agent) components when the composition is a liquid, particularly aqueous washing and cleaning agents that are enjoying an increased popularity due to their positive product properties, such as a better and faster solubility and practicality. Due to the decomposition reactions or hydrolysis and incompatibilities towards other constituents of the washing agent formulation, such as, e.g., enzymes or surfactants, the added bleaching agents often lose their activity already on storage or even during product utilization. An adverse consequence resulting from this is that the washing performance—particularly the bleaching power—of the washing agent formulation noticeably deteriorates, such that bleachable stains in particular can no longer be satisfactorily removed.

Bleaching agents, such as for example perborates or percarbonates, which are usually used in solid washing agent formulations, are extremely moisture sensitive, with the result that they often lose their bleaching power within a few days in a liquid and particularly aqueous washing or cleaning agents, due to the loss of active oxygen.

Decomposition of hydrogen peroxide caused by catalytically active substances, such as metal ions, is extremely difficult to prevent. For products that contain hydrogen peroxide to be effective, a substantial proportion of the hydrogen peroxide must survive between manufacture and use. In addition, decomposition produces oxygen gas, which could overpressure the container and cause it to rupture during storage or shipping. Examples of such compositions are given, for example, in Kott, U.S. Pat. No. 5,641,739; Scialla, U.S. Pat. No. 5,559,090; Monticello, U.S. Pat. No. 6,106,774; and Kandathil, U.S. Pat. No. 4,238,192.

Liquid detergent compositions offer several advantages over solid compositions. For example, liquid compositions are easier to measure and dispense. Additionally, liquid compositions are especially useful for direct application to heavily soiled areas on fabrics, after which the pre-treated fabrics can be placed in an aqueous bath for laundering in the ordinary manner.

Unfortunately, unless very stringent conditions are met, hydrogen peroxide solutions begin to decompose into $O_2$ gas and water within an extremely short time. Typical hydrogen peroxide solutions in use for these purposes are in the range of from about 0.5 to about 6% by weight of hydrogen peroxide in water. The rate at which such dilute hydrogen peroxide solutions decompose will, of course, be dependent upon such factors as pH and the presence of trace amounts of various metal impurities, such as copper or chromium, which may act to catalytically decompose the same. Moreover, at moderately elevated temperatures, the rate of decomposition of such dilute aqueous hydrogen peroxide solutions is greatly accelerated. Hence, hydrogen peroxide solutions which have been stabilized against peroxide breakdown are in very great demand.

SUMMARY OF THE INVENTION

The objective of this invention is to develop a stable, liquid bleach composition that contains a peroxide-based bleaching agent, water, and a metal catalyst. The present invention contains a polyol as a secondary solvent to promote peroxide stability in the presence of a catalyst.

DETAILED DESCRIPTION OF THE INVENTION

Figure 1:
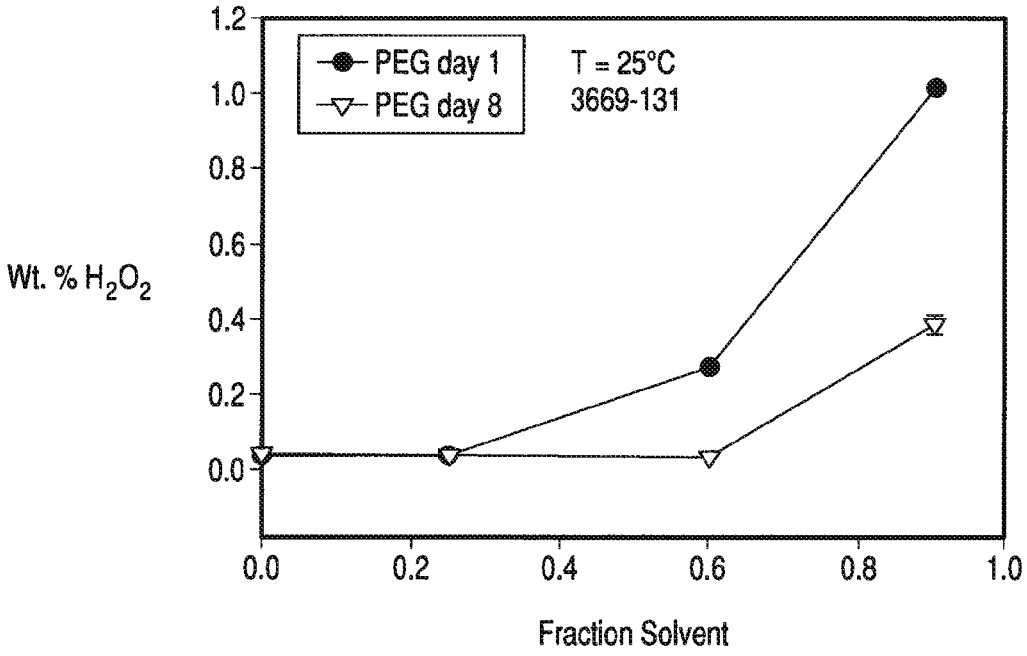
FIG. 1 shows a plot of % $H_2O_2$ as a function of the fraction of PEG in the PEG/water portion of each sample of peroxide containing cleaning composition having a metal catalyst.

The objective of this invention is to develop a stable, liquid bleach composition that contains a peroxide-based bleaching agent, water, and a metal catalyst. Current bleaching compositions that contain a metal catalyst are typically in solid form. The present invention contains a polyol as a secondary solvent to promote peroxide stability in the presence of a catalyst.

Though incorporation of a catalyst with a peroxide-based bleaching agent is common for solid systems, there are no such combinations for liquid systems. The reason liquid systems do not contain both peroxide and catalyst is that in solution, the catalyst causes the degradation of the peroxide through a series of reactions:

$$M_{red}+H_2O_2 \rightarrow M_{ox}+.OH+OH^-$$

$$M_{red}+.OH \rightarrow M_{ox}+OH^-$$

$$H_2O_2+.OH \rightarrow .OOH+H_2O$$

$$M_{red}+.OOH \rightarrow M_{ox}+HOO^-$$

$$M_{ox}+.OOH \rightarrow M_{red}+H+O_2$$

where $M_{red}$ and $M_{ox}$ are the reduced and oxidized forms of the metal ion, respectively. Other authors report slightly different mechanisms. (see M. Lewin, in Ch. 2 of Chemical Processing of Fibers and Fabrics, Fundamentals and Preparation, Part B, M. Lewin and S. B. Sello (ed.), Marcel Dekker, Inc., New York, 1984, pp. 178-79).

Polyol

It has surprisingly been found that when using a polyol as a secondary solvent in the bleach composition containing both a peroxide and a metal catalyst, the polyol and water mixture was particularly effective in promoting peroxide stability in the presence of the catalyst.

It has been found that the choice of the polyol solvent used in the present invention can be defined by considering the three dimensional solubility parameter of the material. The solubility parameter δ is defined as the square root of the cohesive energy density associated with a material. The cohesive energy density characterizes the attractive strength between molecules of the material.

Three attractive interactions between molecules, i.e. dispersive, polar, and hydrogen bonding are defined in separate solubility parameters, which subsequently relate to the attractive interactions associated with the three interactions. These parameters are:

$\delta d$=dispersive solubility parameter $\delta p$=polar solubility parameter $\delta h$=hydrogen-bonding solubility parameter Using these three coordinates, a three-dimensional space can be defined (called the Hansen space). Thus, a material in that space is defined as a point with coordinates δd, δp, and δh. For example, in the present invention, glycerin has been found effective in promoting stability in the bleach composition. The parameters for glycerin are the following, $$\delta d=17.4\ (\mathrm{MPa})^{1/2}$$

$$\delta p=12.1\ (\mathrm{MPa})^{1/2}$$

$$\delta h=29.3\ (\mathrm{MPa})^{1/2}$$

Appropriate solvents for this invention are chosen from materials which lie within a sphere in the Hansen space, defined by a radius R=6 $(\mathrm{MPa})^{1/2}$ or less. In evaluating whether a solvent is appropriate the sphere radius may be calculated from:

$$R=[(\delta p1-\delta p2)^2+(\delta h1-\delta h2)^2+4(\delta d1-\delta d2)^2]^{1/2}$$

where solvent 1 corresponds to values for glycerin and those for solvent 2 correspond to the test solvent. In practical terms for current commercial preparations, typical amounts of polyol are typically from 5% to 90%, preferably 25-35%, by weight of a commercial detergent preparation.

For example, polyols useful in this invention and contained within the desired Hansen space include glycerin, sorbitol, xylitol, mannitol, trihydroxy butane, tetrahydroxy pentane, and ethylene glycol. Mixtures of suitable polyols are also useful.

Catalyst

It is well-known that certain heavy metals, or complexes thereof, function to catalyze the decomposition of hydrogen peroxide, or of compounds which are capable of liberating hydrogen peroxide, in order to render the peroxide compound effective at temperatures below 60° C.

The composition of the present invention comprise metal-containing bleach catalysts. One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn._{IV2}(u\text{-}O)_3$(1,4,7-trimethyl-1,4,7-triazacyclononane)$_2$-$(PF_6)_2$("MnTACN"), $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$-(1,4,7-trimethyl-1,4,7-triazacyclononane)$_2$-$(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

Bleach catalysts of particular use in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane$(OCH_3)_3$—$(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylitol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

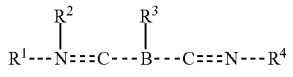

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe, -bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N^4)^+$ and $[Bipy_2Mn^{III}(u\text{-}O)_2Mn^{IV}bipy_2]$-$(ClO_4)_3$.

The bleach catalysts may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Another example of a metal catalyst suitable for the present invention is described in U.S. Pat. No. 6,528,469. U.S. Pat. No. 6,528,469 describes certain other manganese compounds that are also excellent bleach catalysts for peroxy compounds and, relative to known bleach catalysts, provide enhanced bleach effects at low wash temperatures (e.g. at 15 to 40° C.) and/or using shorter washing times. The peroxy compounds may be produced by known methods, e.g. by the methods analogous to those disclosed in U.S. Pat. No. 4,655,785 relating to similar copper compounds.

Other catalysts, such as Fe, Ni, Cr, Cu, etc. could be employed. This may require a different polyol concentration that a person of ordinary skill in the art could find without undue experimentation. In addition, U.S. Pat. No. 6,093,343 describes various cobalt catalysts that could be used in the present invention.

In practical terms for current commercial preparations, typical amounts of catalyst used in the present invention are typically from 0.2% to 5%, preferably 0.25% to 0.75%, by weight of a commercial detergent preparation.

Bleaching Agent

The peroxy component of the bleach compositions used in the present invention may be hydrogen peroxide, a compound which liberates hydrogen peroxide, a peroxyacid, a peroxyacid bleach precursor or a mixture thereof.

Compounds which liberate hydrogen peroxide are well known and include, e.g., inorganic compounds such as alkali metal peroxides, -perborates, -percarbonates, -perphosphates and -persulfates and organic compounds such as peroxylauric acid, peroxybenzoic acid, 1,12-diperoxydodecanoic acid, diperoxyisophthalic acid and urea peroxide, as well as mixtures thereof. Sodium percarbonate and sodium perborate, in particular sodium perborate monohydrate, are preferred.

Peroxyacid compounds and peroxyacid bleach precursors are also well known and a summary of references describing them is provided in the above-mentioned U.S. Pat. No. 5,114,606.

The preferred bleaching agents employed for the present invention are classified broadly as oxygen bleaches. The oxygen bleaches are represented by percompounds which are true per salts or ones which liberate hydrogen peroxide in solution. Preferred examples include sodium and potassium perphosphates, perborates, percarbonates, and monopersulfates.

In addition, hydrogen peroxide may be used in the present invention. Hydrogen peroxide is typically employed as a concentrated aqueous solution, such as the 50% active Peroxal CG 50 HP (Arkema). Commercial grades also typically employ a number of ingredients to maintain stability, such as stannates, phosphonates, or additional chelants. The pH levels of these commercial grade peroxides are typically kept below 3 in order to further maintain improved stability. It is important to note, however, that in the present invention, such stabilizers probably contribute little to stability in the presence of the included catalyst. Stability appears largely governed by the choice of the polyol secondary solvent (as noted above and in the Examples below).

In practical terms for current commercial preparations, typical amounts of the peroxy compound are typically from 0.5% to 12%, preferably 0.5-6%, of hydrogen peroxide of a commercial detergent preparation. Peroxide generating salts would be used at levels that could generate these amounts, so long as the use of such amounts is possible without promoting formula instability.

Surfactants

The bleach compositions of the present invention may contain at least one anionic or nonionic surfactant or a mixture of the two types of surfactant.

One or more nonionic surfactants may be included in the detergent of the present invention. Suitable nonionic surfactant compounds may fall into several different chemical types. Preferred nonionic surfactants are polyoxyethylene or polyoxypropylene condensates of organic compounds. Examples of preferred nonionic surfactants are:

(a) Polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acid (derived from coconut oil) which contains an average of about 12 carbon atoms, "tallow" fatty acids (derived from tallow-class fats) which contains an average of about 18 carbon atoms, palmitic acid, myristic acid, stearic acid and lauric acid;

(b) Polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol (derived from coconut oil), "tallow" fatty alcohol (derived from the tallow-class fats), lauryl alcohol, myristyl alcohol, and oleyl alcohol.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms. Specific sulfated surfactants which can be used in the compositions of the present invention include sulfated ethoxylated and unethoxylated fatty alcohols, preferably linear primary or secondary monohydric alcohols with $C_{10}$-$C_{18}$, preferably $C_{12}$-$C_{16}$, alkyl groups and, if ethoxylated, on average about 1-15, preferably 3-12 moles of ethylene oxide (EO) per mole of alcohol, and sulfated ethoxylated alkylphenols with $C_8$-$C_{16}$ alkyl groups, preferably $C_8$-$C_9$ alkyl groups, and on average from 4-12 moles of EO per mole of alkyl phenol.

Anionic surfactants are well known to those skilled in the art. Typical anionic surfactants include sulfates and sulfonate salts, such as $C_8$ to $C_{12}$ alkylbenzene sulfonates, $C_{12}$ to $C_{16}$ alkane sulfonates, $C_{12}$ to $C_{16}$ alkyl sulfates, $C_{12}$ to $C_{16}$ alkylsulfosuccinates, and sulfates of ethoxylated and propoxylated alcohols, such as those described above. Typical anionic surfactants include, for example, sodium cetyl sulfate, sodium lauryl sulfate, sodium myristyl sulfate, sodium stearyl sulfate, sodium dodecylbenzene sulfonate, and sodium polyoxyethylene lauryl ether sulfate. Sodium lauryl(dodecyl)sulfate (SLS) is commonly used in cleaning agents.

In practical terms for current commercial preparations, typical amounts of surfactant used in the present invention are typically from 2% to 20%, preferably 5-15%, by weight of a commercial detergent preparation.

Stabilizers and pH Buffers

The compositions of the present invention may also contain various additional stabilizers and/or pH buffers, especially borate-type stabilizers or pH buffers. Compounds such as boric acid, boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

In practical terms for current commercial preparations, typical amounts of stabilizers and/or pH buffers are typically from 0.1% to 10%, preferably 0.25-1%, by weight of a commercial detergent preparation.

Other Agents

The composition of the present invention may also, optionally, contain chelating agents, dye transfer inhibiting agents, dispersants, enzymes, enzyme stabilizers, polymeric dispersing agents, clay soil removal/anti-redeposition agents, brighteners, suds suppressors, dyes, perfumes, structure elasticizing agents, bleach activators, fabric softeners, carriers, hydrotropes, processing aids, solvents, pigments, hueing agents, structurants, and mixtures thereof.

EXAMPLES

A series of formulations were made containing the peroxide CG50 HP® (Arkema), a 50% active form of $H_2O_2$ with improved alkaline pH stability. The catalyst used was the Tinocat® TRS KB2 (Ciba), composed of a manganese ion complexed to three Schiff base ligands:

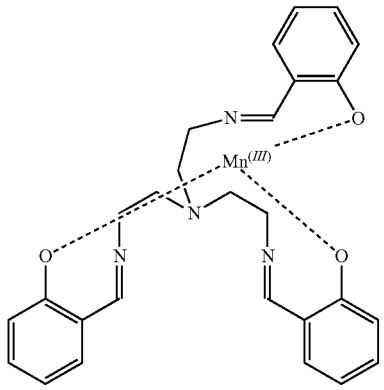

The compositions contained polyethylene glycol (PEG) 400, dipropylene glycol monobutyl ether (Dowanol DPnB), or glycerin as the anhydrous portion. Two separate studies of glycerin systems were performed in order to reproduce the surprising results. The basic formulations studied are shown below (all values on an actives basis):

TABLE 1

Formulations of peroxide based cleaning agents

| | 1 | 2 | 3 | 4 | 5 | 6 | 7 | 8 |
|---|---|---|---|---|---|---|---|---|
| $H_2O_2$ (from Arkema CG50 HP) | | | | 1.00 | | | | |
| Tinocat TRS KB2 | | | | | | 0.50 | | |
| Tomadol 1-7 | | | | 8.00 | | | | |
| PEG 400, DPnB, or Gycerin | 0 | 22.625 | 54.30 | 81.45 | 0 | 22.50 | 54.00 | 81.00 |
| Borax ($Na_2B_4O_7$•$10H_2O$) | | | | 0.50 | | | | |
| Water | 90.50 | 67.875 | 36.20 | 9.05 | 90.00 | 67.50 | 36.00 | 9.00 |
| Fraction of solvent in Solvent + Water | 0 | 0.25 | 0.60 | 0.90 | 0 | 0.25 | 0.60 | 0.90 |

Samples were evaluated via a permanganate titration one day following formulation and eight days following formulation. Levels of $H_2O_2$ for each formulation were determined through titration with 0.1 N $KMnO_4$ under acidic conditions. The oxidation of $H_2O_2$ by $MnO_4^-$ is typically expressed through the reaction $$5H_2O_2(aq)+6H^+(aq)+2MnO_4^-\rightarrow 5O_2+2Mn^{2+}(aq)+8H_2O$$

However, an equally acceptable balanced version is $$H_2O_2(aq)+6H^+(aq)+2MnO_4^-\rightarrow 3O_2+2Mn^{2+}(aq)+4H_2O$$

This equation was the relationship assumed in the calculations, and is consistent with other published methods. (see American Chemical Society, Reagent Chemicals, Sixth Ed., American Chemical Society, Washington, D.C., 1981, pp. 287-88).

In all cases where no catalyst was present, levels of peroxide were fairly constant around the target of 1% of the entire eight day period. Varied behaviors were seen in the catalyst systems. First shown in FIG. 1 is a plot of % $H_2O_2$ as a function of the fraction of PEG in the PEG/water portion of each sample. The data shown in FIG. 1 are only for the samples containing Tinocat because all samples without the catalyst maintained initial levels of peroxide. The plot in FIG. 1 is shown for one day and eight day old samples.

As can be seen in FIG. 1, at the one day and at the eight day marks, decreasing the amount of water increased the stability of the peroxide. However, even at a PEG fraction of 0.9, a significant reduction in the level of peroxide was seen after eight days.

Figure 2:
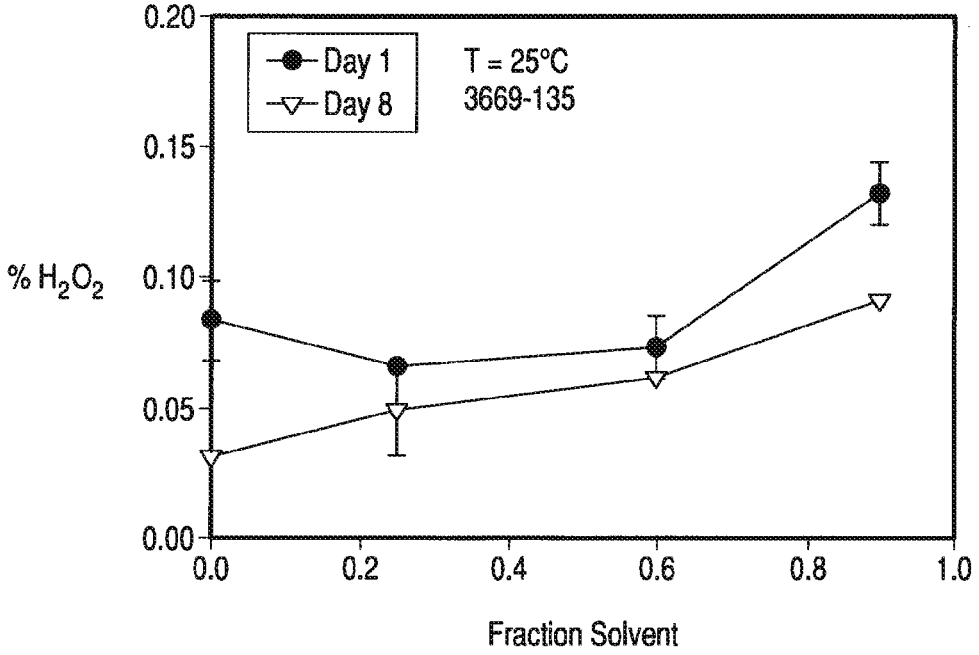
FIG. 2 shows a plot of % $H_2O_2$ as a function of the fraction of DPnB in the DPnB/water portion of each sample of peroxide containing cleaning composition having a metal catalyst.

As can be seen in FIG. 2, even larger reductions of the peroxide levels were seen in the case in the case of DPnB systems (note the very low levels of peroxide even after only one day and high solvent levels).

Figure 3:
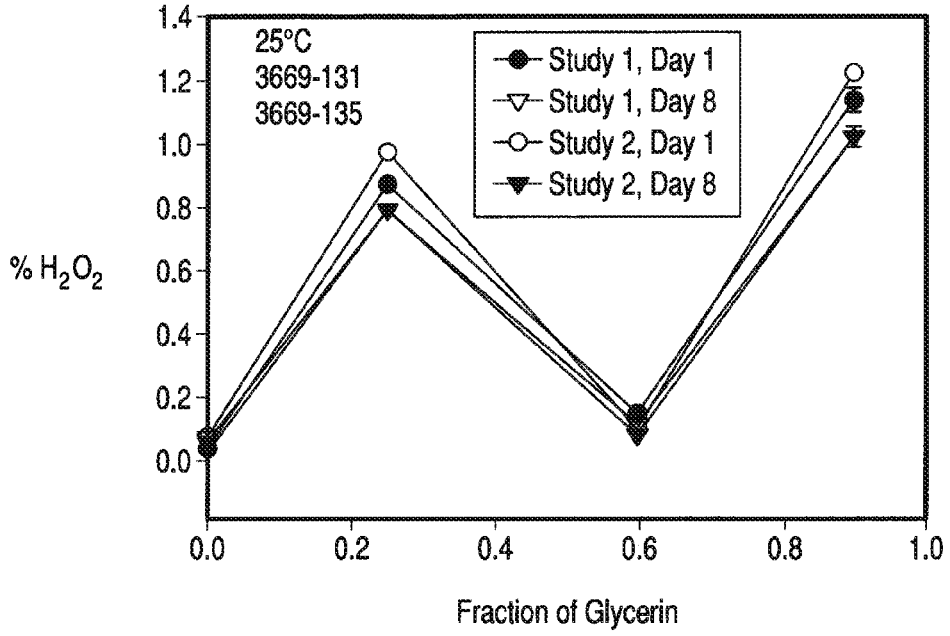
FIG. 3 shows a plot of % $H_2O_2$ as a function of the fraction of glycerin in the glycerin/water portion of each sample of peroxide containing cleaning composition having a metal catalyst.

However, significantly different results were obtained in the case of glycerin. FIG. 3 shows the results for two different studies done on glycerin systems. The data displayed in FIG. 3 show that the behavior in glycerin systems was quite reproducible. High degrees of stability were seen especially in systems having glycerin fractions of about 0.25 and 0.9.

Another study of glycerin systems was performed, using a range of glycerin levels with finer resolution. The following compositions were prepared (all shown on an actives basis) and the formulations are in Table 2.

TABLE 2

Formulations of various glycerin/water systems

| | 1 | 2 | 3 | 4 | 5 | 6 | 7 | 8 | 9 |
|---|---|---|---|---|---|---|---|---|---|
| $H_2O_2$ (from Arkema CG50 HP) | | | | | 1.00 | | | | |
| Tinocat TRS KB2 | | | | | 0.50 | | | | |
| Tomadol 1-7 | | | | | 8.00 | | | | |
| PEG 400, DPnB, or Gycerin | 0 | 9.00 | 18.00 | 27.00 | 36.00 | 45.00 | 54.00 | 72.00 | 81.00 |
| Borax ($Na_2B_4O_7$•$10H_2O$) | | | | | 0.50 | | | | |
| Water | 90.00 | 81.00 | 72.00 | 63.00 | 54.00 | 45.00 | 36.00 | 18.00 | 9.00 |
| Fraction of solvent in Solvent + Water | 0 | 0.1 | 0.2 | 0.3 | 0.4 | 0.5 | 0.6 | 0.8 | 0.9 |

Figure 4:
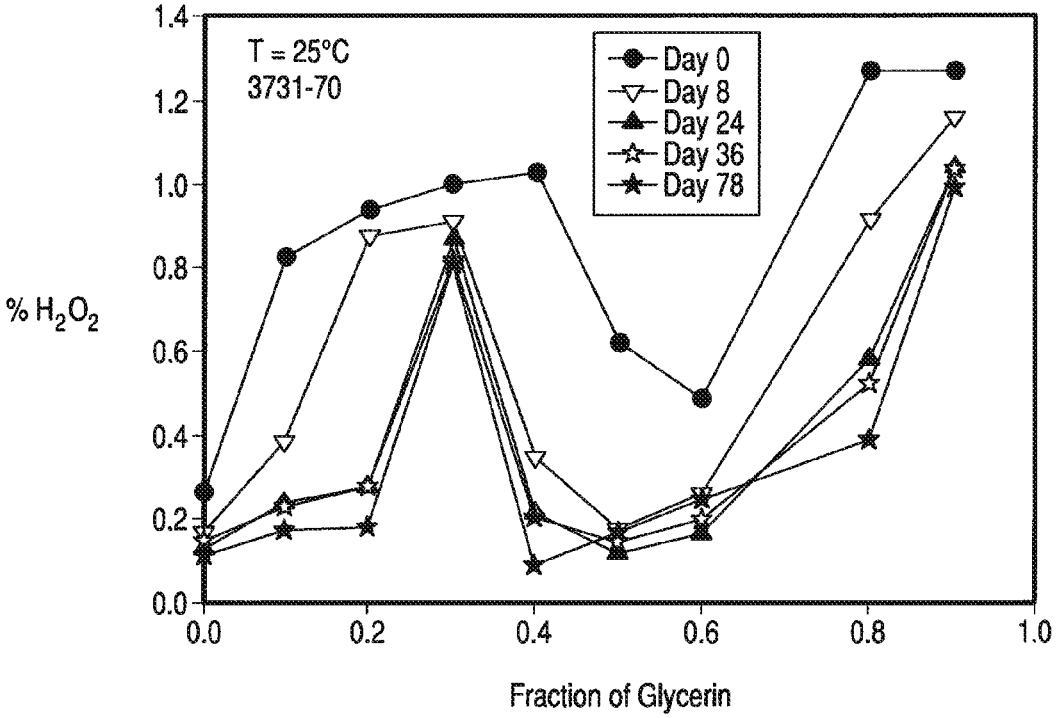
FIG. 4 shows a plot of % $H_2O_2$ as a function of the fraction of glycerin in the glycerin/water portion of each sample of peroxide containing cleaning composition having a metal catalyst.

Levels of peroxide were evaluated as noted above at various times between day 0 and day 78, after incubation at 25° C. Peroxide levels are plotted in FIG. 4 as a function of glycerin fraction in the water+glycerin mixture. The maxima seen in the plot above are consistent with the previously observed behaviors for glycerin. At glycerin fractions of about 0.25 to 0.3, peroxide stability in the presence of a catalyst is especially enhanced.

To better understand contributing factors to the peroxide stability, a series of evaluations were performed to monitor the level of Mn catalyst dissolved in the formulated systems (as opposed to being dispersed and non-solvated). Compositions 1, 4, 7, and 9 in Table 2 were prepared as shown, except that the hydrogen peroxide was omitted. The samples were then allowed to equilibrate for at least 48 hours. An aliquot of each sample was removed and filtered through a 0.2 micron filter. Filtrates were then analyzed via inductively coupled plasma spectrometry for the presence of manganese. Table 3 shows levels of manganese detected in each case.

TABLE 3

Levels of manganese in formulation filtrates

| Sample | Fraction of solvent in Solvent + Water | Manganese (ppm) |
|---|---|---|
| 1 | 0 | 3.3 |
| 4 | 0.30 | 50.8 |
| 7 | 0.60 | 30.0 |
| 9* | 0.90 | Top phase: 4.3<br>Bottom phase: 2.2 |

*Sample 9 (without CG 50 HP) separated into two liquid phases

The solubility data suggests that a maximum in the catalyst solubility coincided with an optimum peroxide stability. Without being constrained by theory, the data supports the argument that changing the polarity of the continuous phase can have a profound effect on peroxide stability. One could use this principle to formulate a peroxide and catalyst system with a glycerin fraction of (as in these examples) 0.25-0.30 in the water and glycerin mixture. In use, the product would be diluted (as in the case of a laundry additive or dilutable cleaner), the polarity of the surrounding solvent would change, and the peroxide should become more active (and less stable).

Other catalysts, such as Fe, Ni, Cr, Cu, etc. could be employed. This may require a different optimal glycerin concentration, which one of ordinary skill in the art would know without undue experimentation. Other polyols, such as isomers of trihydroxy butane and tetrahydroxy pentane, and ethylene glycol may be employed. Polyols such as sorbitol, xylitol, and mannitol, which are solids at room temperature but are soluble in water, may also be employed.

We claim:

1. A stable liquid cleaning composition comprising:

a) a hydrogen peroxide component;

b) a manganese catalyst;

c) glycerin; and d) water, wherein the ratio of glycerin to the total amount of said glycerin and water is 0.25 to 0.35.

2. A liquid cleaning composition comprising:

a) a peroxy component;

b) a metal-containing bleach catalyst;

c) a polyol which lies within a sphere in the Hansen space, defined by a radius R=6 $(MPa)^{1/2}$ or less; and d) water, wherein the ratio of said polyol to the total amount of said polyol and water is 0.25 to 0.35.

3. The composition of claim 1 wherein the peroxy component is hydrogen peroxide.

4. The composition of claim 1 wherein the peroxy component is a stabilized hydrogen peroxide composition.

5. The composition of claim 1 wherein the metal is selected from the group of transition metals consisting of Mn, Co, Fe, or Cu.

6. The composition of claim 1 wherein the metal is Mn.

7. The composition of claim 1 wherein the polyol is glycerin, sorbitol, xylitol, mannitol, trihydroxy butane, tetrahydroxy pentane, or ethylene glycol and mixtures thereof.

8. The composition of claim 1 wherein the polyol is glycerin.

9. The composition of claim 1 further comprising a surfactant.

10. The composition of claim 1 wherein the weight percentage of said catalyst is 0.2 to 2% of the overall composition.

* * * * *